US007565787B2

(12) United States Patent
Licari

(10) Patent No.: US 7,565,787 B2
(45) Date of Patent: Jul. 28, 2009

(54) WRINKLE-REDUCING DEVICE AND METHOD FOR ROLLING CLOTHING

(76) Inventor: Yaffa Sheina Licari, 400 Chambers St., Apartment 24-G, New York, NY (US) 10208

( * ) Notice: Subject to any disclaimer, the term of this patent is extended or adjusted under 35 U.S.C. 154(b) by 567 days.

(21) Appl. No.: 10/442,534

(22) Filed: May 21, 2003

(65) Prior Publication Data

US 2004/0134167 A1 Jul. 15, 2004

Related U.S. Application Data

(60) Provisional application No. 60/456,052, filed on Mar. 20, 2003, provisional application No. 60/439,411, filed on Jan. 10, 2003.

(51) Int. Cl.
*B65B 63/04* (2006.01)

(52) U.S. Cl. ..... 53/429; 53/430; 53/118; 206/278; 242/613.3

(58) Field of Classification Search ..... 53/116–118, 53/429, 430; 206/278, 286, 292, 63.3, 525, 206/525.1; 229/87.15, 87.17; 223/37, 71, 223/84, 38; 242/613.3, 610.1, 222
See application file for complete search history.

(56) References Cited

U.S. PATENT DOCUMENTS

| | | | | | |
|---|---|---|---|---|---|
| 374,281 | A | * | 12/1887 | Voorhees | 229/87.15 |
| 1,388,561 | A | * | 8/1921 | Grote | 206/388 |
| 1,955,244 | A | * | 4/1934 | Liebowitz | 223/37 |
| 2,057,110 | A | | 10/1936 | Peiffer | |
| 2,243,230 | A | | 5/1941 | Vandermade | |
| 2,383,389 | A | * | 8/1945 | Illion | 206/278 |
| 2,567,385 | A | * | 9/1951 | Lighter | 53/399 |
| 2,974,837 | A | * | 3/1961 | Boehmer | 223/71 |
| 3,389,841 | A | * | 6/1968 | Schwartz | 223/71 |
| 3,891,129 | A | | 6/1975 | Knappe et al. | |
| 3,962,758 | A | | 6/1976 | Knappe et al. | |
| 4,071,139 | A | * | 1/1978 | Pernicano et al. | 206/216 |
| D265,863 | S | * | 8/1982 | McCarn | D3/23 |
| 4,778,050 | A | | 10/1988 | Baptiste | |
| 4,944,436 | A | * | 7/1990 | Moen et al. | 223/98 |
| 5,181,670 | A | * | 1/1993 | Eaton et al. | 206/296 |
| 5,269,407 | A | * | 12/1993 | Hall | 206/292 |

(Continued)

FOREIGN PATENT DOCUMENTS

| | | | |
|---|---|---|---|
| JP | 2003052521 | * | 2/2003 |

(Continued)

OTHER PUBLICATIONS

CBSNEWS.com, Advise For A Bon Voyage, Article, New York, Dec. 15, 2001, 2 pgs.

(Continued)

*Primary Examiner*—Stephen F. Gerrity

(57) ABSTRACT

A device for rolling clothing and storing clothing in rolled form reduces wrinkling and visible folds. A particular article of clothing is easily accessed from storage. When used with a shirt, the device is placed on the back of the shirt, centered with the collar and slightly below the armpits. The shirt is then captured by the device and the shirt arms folded over. The shirt is then rolled starting with the collar. As the shirt is continued to be rolled the wrinkle reducing rolling device becomes an internal structural element to the shirt.

16 Claims, 8 Drawing Sheets

U.S. PATENT DOCUMENTS

| | | | | |
|---|---|---|---|---|
| 5,316,139 | A | 5/1994 | Judd et al. | |
| 5,593,029 | A * | 1/1997 | Both | 206/278 |
| 5,624,026 | A * | 4/1997 | Chernoff | 206/289 |
| 5,687,924 | A * | 11/1997 | Reiche et al. | 206/388 |
| 5,699,904 | A * | 12/1997 | Ikemoto | 206/296 |
| 5,718,331 | A | 2/1998 | Smith | |
| 6,176,378 | B1 * | 1/2001 | Neubauer et al. | 223/85 |
| 6,497,382 | B2 * | 12/2002 | King | 242/405.2 |
| 2002/0113099 | A1 | 8/2002 | Kim | |
| 2004/0094438 | A1 * | 5/2004 | Ahoff | 206/278 |

FOREIGN PATENT DOCUMENTS

| | | | |
|---|---|---|---|
| WO | WO 02/081334 | * | 10/2002 |

OTHER PUBLICATIONS

The DETROIT NEW.COM, How to pack to perfection Article, Apr. 10, 2001, 2 pgs.

* cited by examiner

WRINKLE-REDUCING DEVICE AND METHOD FOR ROLLING CLOTHING

CROSS REFERENCES TO RELATED APPLICATIONS

This application claims the benefit under 35 U.S.C. 119(e) of U.S. Provisional Application Ser. No. 60/439,411, entitled Wrinkle-Reducing Device For Rolling Clothing, filed on Jan. 10, 2003 and U.S. Provisional Application Ser. No. 60/456,052, entitled Further Embodiments Of Wrinkle-Reducing Device For Rolling Clothing, filed on Mar. 20, 2003.

FIELD OF INVENTION

The present invention relates to a device for storing clothing and more particularly the reduction of wrinkling for stored clothing.

BACKGROUND OF THE INVENTION

Wearing wrinkled clothing presents a poor image unsuitable in almost all social and business environments. In an ideal world, there would be unlimited closet space where garments such as shirts, blouses, sweaters, sweatshirts, pants, etc. would be hung on thick padded hangers with sufficient space between the hangers to avoid having the garments touching. However closet space is often limited and clothing on hangers are tightly squeezed against each other, or folded and stuffed into drawers. Unless you are accessing only the top item in a drawer, the items stored above a lower item must be carefully removed and often re-folded to avoid having all the items pull out and/or become wrinkled. Even if you are very careful, folded clothing develops pronounced creases from the pressure applied to the folds. We have only very limited control over the amount of pressure that will be applied to folded clothing. This type of storage will wrinkle the most carefully pressed or ironed article of clothing as the folds set in and the articles of clothing (garments) move (slide) against one another, producing wrinkles in the fabric that will also set in.

One trick that is often suggested is to wrap and to fold individual articles of clothing in plastic or tissue paper. While this technique reduces the wrinkling, it does not reduce let alone eliminate the folds. Another trick long used by backpackers is to roll the clothing rather than fold. While this reduces the number and obviousness of the folds (from key areas such as the chest and back) it actually increases wrinkling of the garments.

Bundled wrapping, which is a method of interfolding multiple articles of clothing reduces the folds and creases, but also requires that the clothing be accessed as a bundle, and unused items must be re-bundle wrapped after one item is selected.

When traveling and living away from home, clothing must be packed tightly to avoid shifting and then stored in drawers or hung up.

Therefore it is desirable to be able to reduce wrinkles and the visibility of folds on stored garments while being able to selectively and rapidly access a particular item of clothing.

SUMMARY OF THE INVENTION

The present invention is a device for rolling clothing and storing clothing in rolled form to reduce wrinkling and visible folds wherein a particular article of clothing is easily accessed from storage.

BRIEF DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

The present invention is a device for rolling clothing and storing clothing in rolled form to reduce wrinkling and visible folds wherein a particular article of clothing is easily accessed from storage. Although the wrinkle-reducing device for rolling clothing is particularly well suited for shirts and blouses and will be so described herein, it is equally well suited for use with sweaters, t-shirts, sweatshirts, jackets, light coats as well as other types of clothing such as pants and vests.

While carefully loosely rolling clothes with tissue paper will keep garments wrinkle free this will only work if the clothes do not shift, move, become squashed or compressed along the rolling axis. While this reduces the number and obviousness of the folds (from key areas such as the chest and back) it actually increases wrinkling of the garments.

By using embodiments of the present invention (wrinkle reducing rolling device) clothes can be rolled quickly and handled easily, permitting storage in a drawer, suitcase, box etc. When the clothing is fully rolled, the wrinkle reducing rolling device imparts an internal skeletal structure to the rolled clothing, greatly reducing the likelihood of the rolled clothing being squashed or compressed along the rolling axis. Additionally, embodiments of the wrinkle reducing rolling device allow a particular item of rolled clothing to be quickly located and removed without wrinkling or refolding other rolled clothing in the drawer. The wrinkle reducing rolling device is suitably sized, such as in small for children's clothing, medium for women's clothing, large for men's clothing, extra large, etc. The rolled clothing can be secured from unrolling with a pin, clip, band or other suitable means.

Clothing rolled with wrinkle reducing rolling device is highly visible and substantially uniform in width, which optimizes storage space. The highly visible chest and back areas of the rolled clothing when unrolled exhibit substantially fewer wrinkles and creases.

Figure 1A:
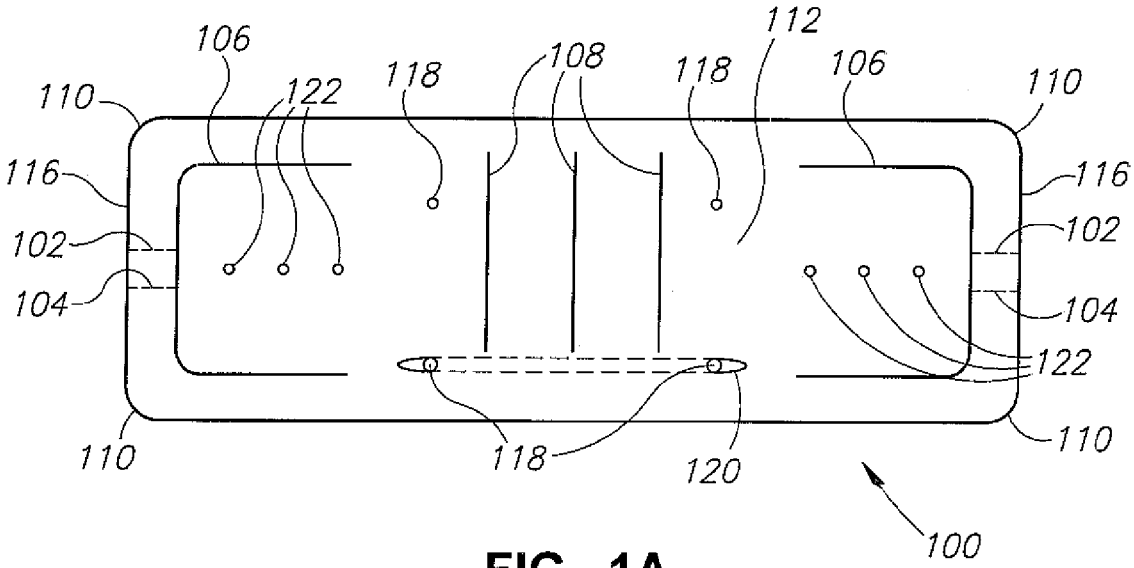
FIG. 1*a* is a top diagrammatic view of the wrinkle reducing rolling device.
Figure 1B:
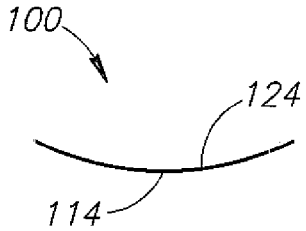
FIG. 1*b* is an end view of the wrinkle reducing rolling device showing the curvature.

Referring to FIGS. 1*a* and 1*b*, there is shown a diagrammatic view of the wrinkle reducing rolling device 100. The wrinkle reducing rolling device 100 has two c shaped cuts 106 having the opening of the c-shapes pointing inwards towards the center of the flexible oblong element and one or more slits 108. The slits 108 provide for the insertion and capture of a foam, paper or cloth insert (not shown). The insert may be treated with cedar essence, antistatic material, a fragrance of the user's choice, as well as can be a lint removal strip. The inserts can be disposable as well as rechargeable. While the use of cedar to reduce damage to clothing is well known, embodiments of the present invention wrinkle reducing rolling device place the cedar essence at the core of the rolled clothing, thus providing optimal protection. In yet a further embodiment, holes 118 are provided for inserting a rod or stick 120 which can be pretreated with cedar essence, antistatic material or user selected fragrance. The stick 120 can be disposable as well as rechargeable. The wrinkle reducing rolling device 100 has a radius curve shown in FIG. 1*b*. This enhances the rolling and further reduces wrinkling.

Corners 110 can be rounded, or textured to enhance capture of the clothing. At least one of the surfaces 112, 114 (such as the convex surface 114) is textured to increase friction to facilitate rolling and reduce sliding and slipping.

Figure 1C:
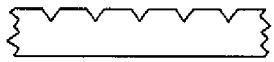
FIG. 1*c* is a detailed close-up of a cross section of one embodiment of the wrinkle-reducing device.
Figure 1D:
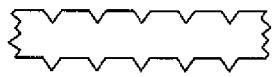
FIG. 1*d* is a detailed close-up of a cross section of another embodiment of the wrinkle-reducing device.
Figure 1E:
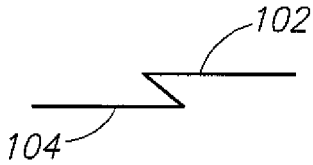
FIGS. 1*e* and 1*f* are a detailed close-up of the folding of the end of the wrinkle reducing rolling device.
Figure 1F:
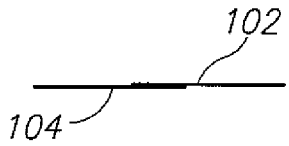

Referring to FIGS. 1*e* and 1*f* in conjunction with FIG. 1*a*, there is shown one preferred embodiment of the wrinkle reducing rolling device where the ends 116 are reduced in length by folding the end at points 102 and 104. The folded or cut material is then bonded, welded or glued with a suitable technology that complements the material that the wrinkle reducing rolling device 100 is made of. This feature (folding or cutting & bonding) converts the "C" shaped cutouts into a snap action clip. The snap action clip has two operating positions: open at the ends when the C cutout is pushed up; and, closed at the ends when the C cutout is pushed down.

In yet a further embodiment, additional holes or perforations 122 are positioned at various locations to make the wrinkle reducing rolling device 100 porous, thus assisting when slightly damp shirts are rolled. The perforations 122 are sufficiently small to avoid leaving a mark or impression on the shirt but in an adequate number to allow the wrinkle reducing rolling device 100 to breath. The moisture can be applied by use of an atomizer (not shown). This technique and embodiment aids in the removal of existing wrinkles on the shirt.

Figure 2:
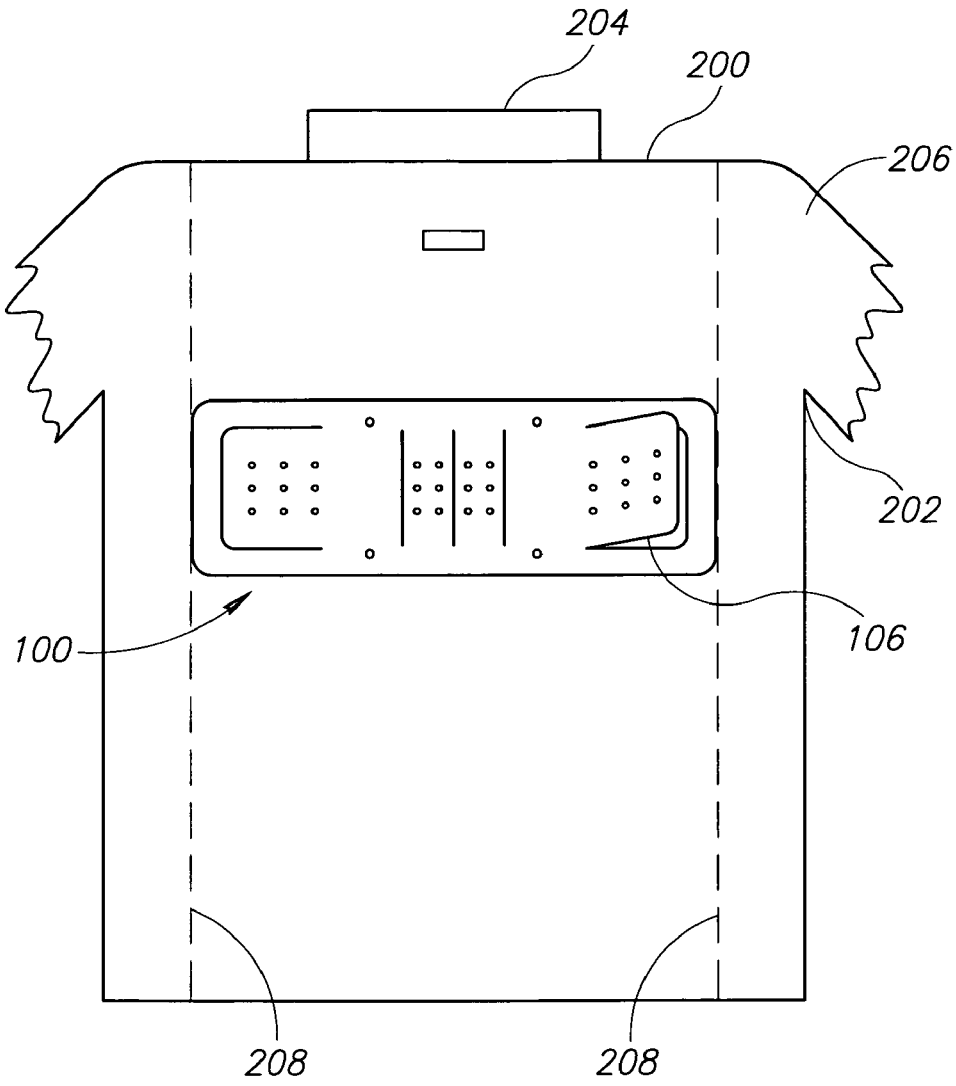
FIG. 2 is a stylized representation of the wrinkle reducing rolling device placed on a shirt ready to be rolled.

Referring to FIG. 2, it can be seen that to roll the shirt the wrinkle reducing rolling device 100 is positioned on the back of the shirt 200 which is placed on a flat smooth surface. The wrinkle reducing rolling device 100 is centered relative to the collar 204 and located at or slightly below the armpits 202 of the shirt 200 with the snap action clip (c shaped cuts) 106 set in the open (up) position.

Figure 3:
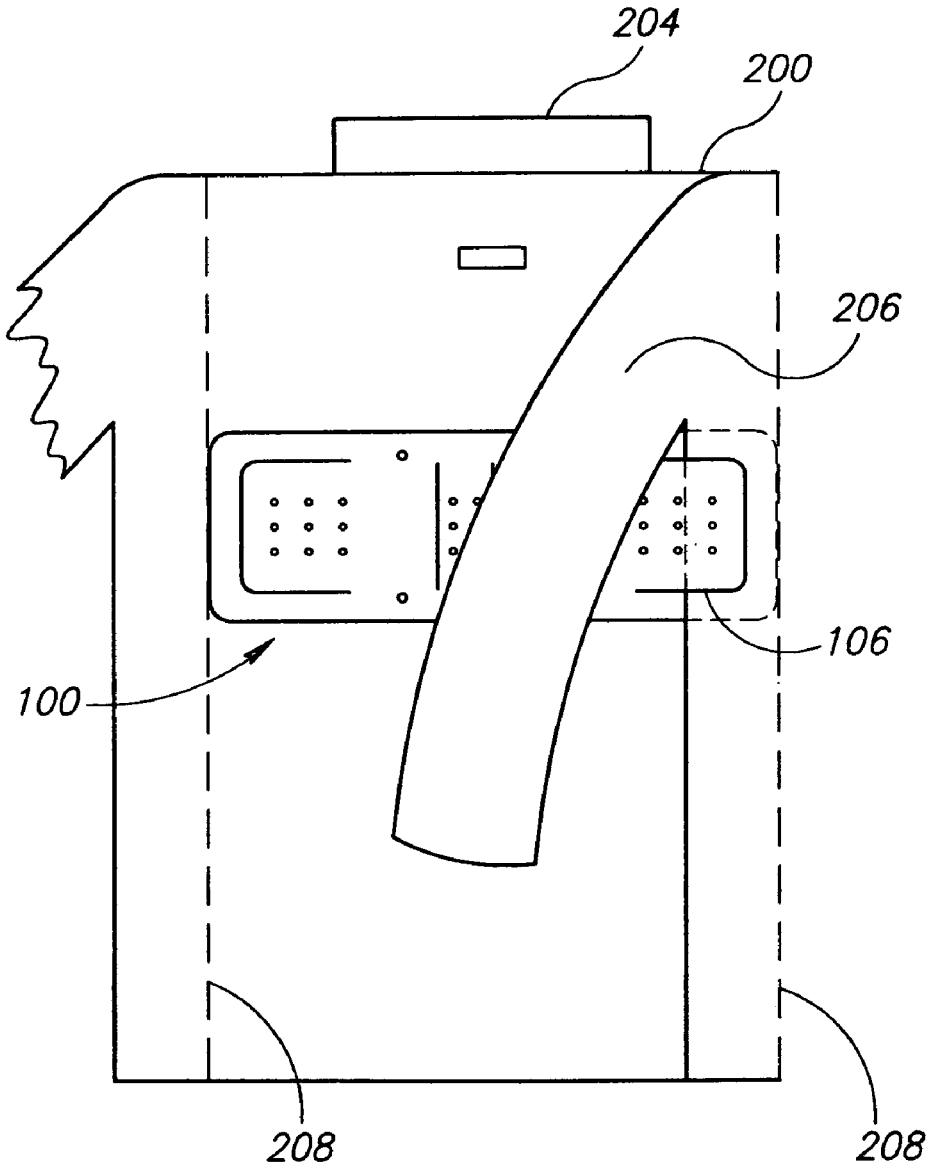
FIG. 3 is a stylized representation of the wrinkle reducing rolling device capturing one side of the shirt.
Figure 4:
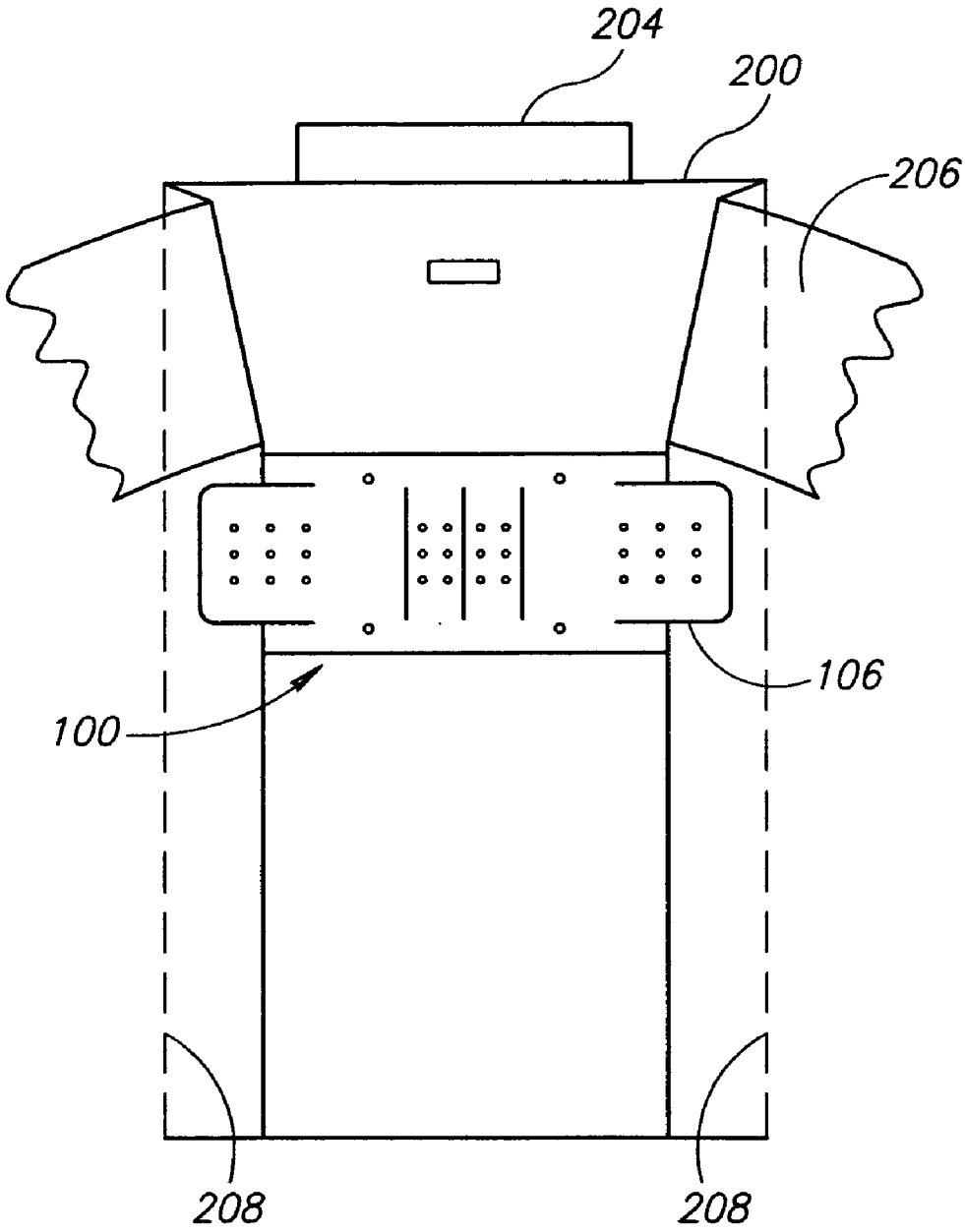
FIG. 4 is a stylized representation of the wrinkle reducing rolling device capturing both sides of the shirt.
Figure 5:
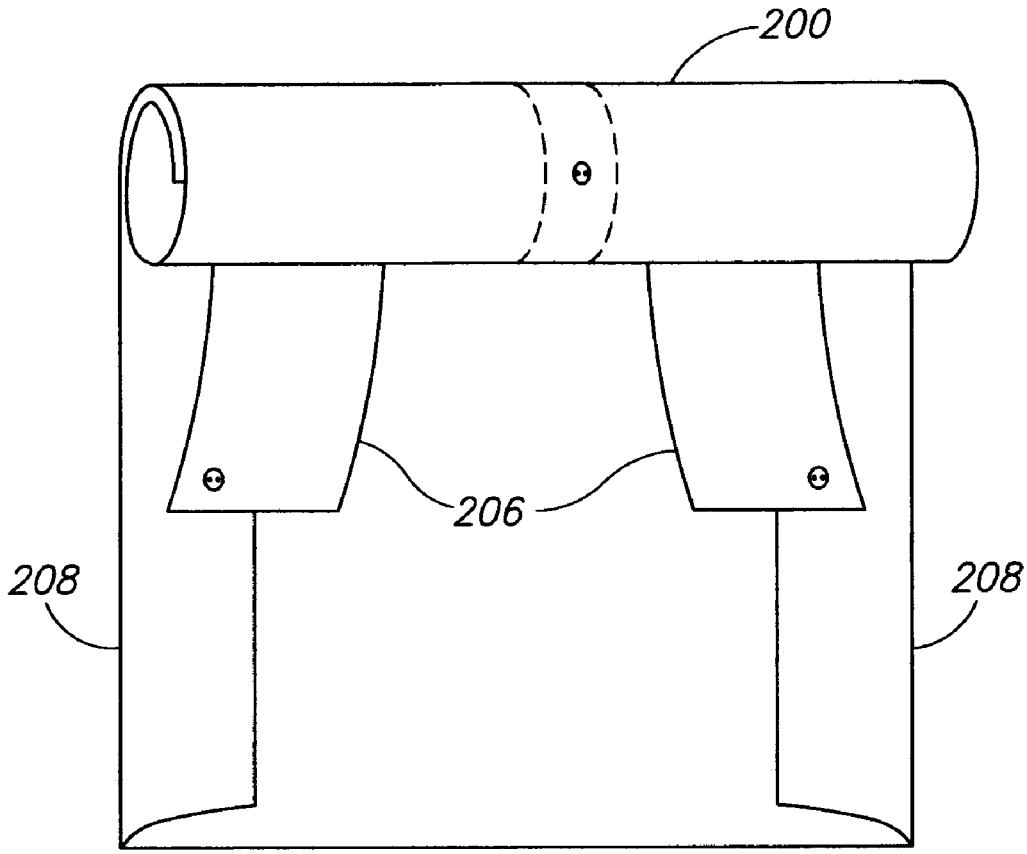
FIG. 5 is a stylized representation of the wrinkle reducing rolling device with the shirt partially rolled.

As can be seen in FIG. 3, the sides of the shirt 200 are then folded back on the wrinkle reducing rolling device 100 along line 208 and the snap action clip 106 is set in the closed position capturing the side edge of the shirt 200 under the armpit 202. The arm 206 is folded across and/or down the shirt 200 over the wrinkle reducing rolling device 100. The actual position and angle of the arm 206 is selected based on the particular style and material the shirt 200 is made of. The arm 206 may be folded straight down as well as at an angle. This is then repeated on the other side edge of the shirt 200 as shown in FIG. 4. The captured shirt 200 is then rolled starting with the collar 204. As the shirt 200 is continued to be rolled, which is shown in FIG. 5, the wrinkle reducing rolling device 100 becomes an internal structural element to the shirt 200.

Figure 6:
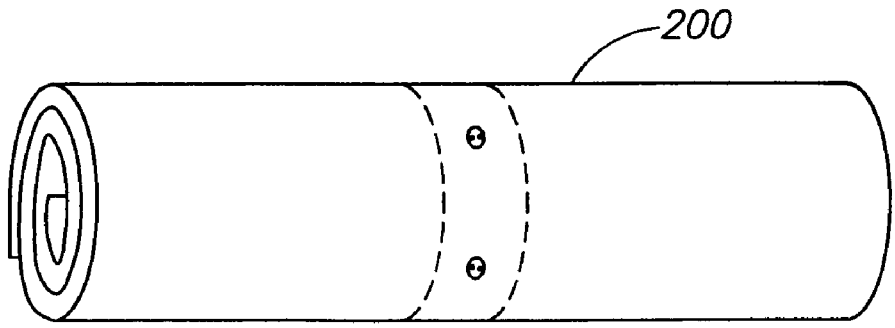
FIG. 6 is a stylized representation of the wrinkle reducing rolling device with the shirt fully rolled.
Figure 7:
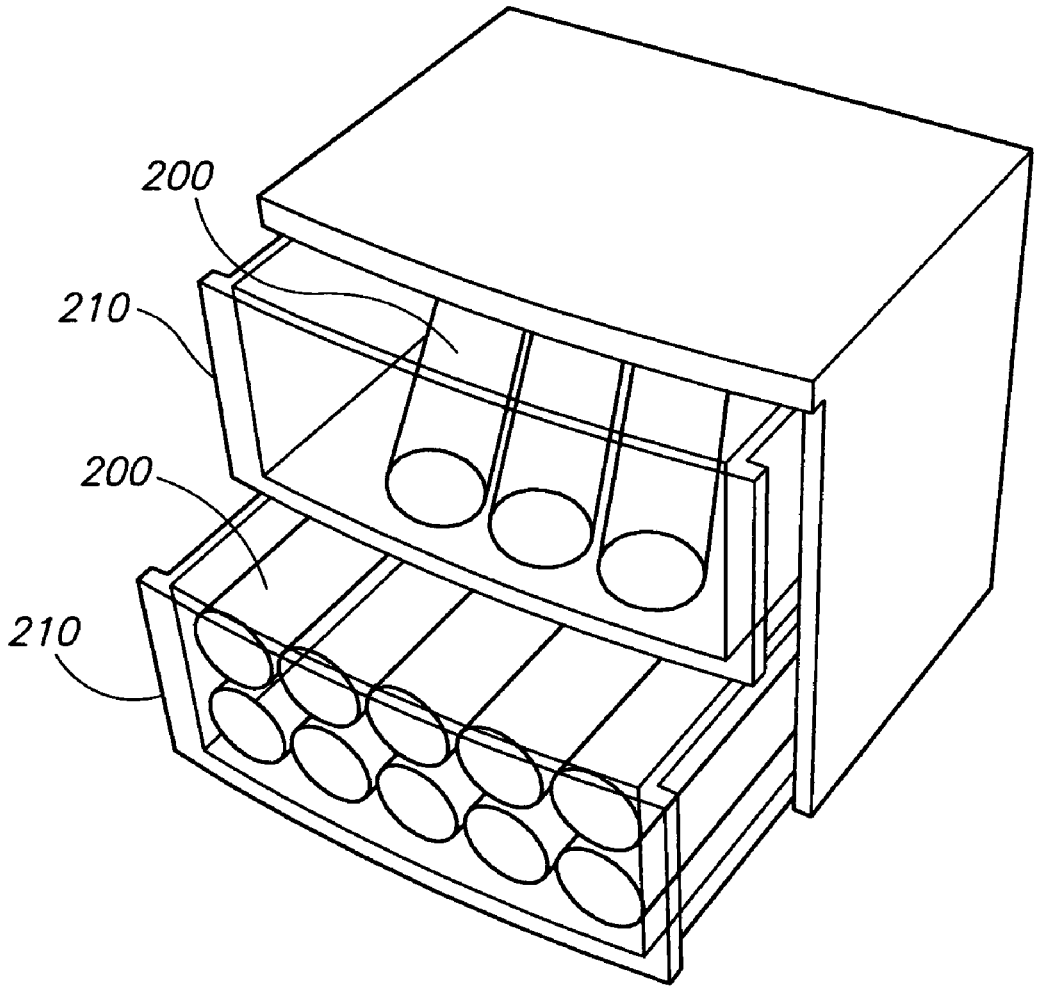
FIG. 7 is a stylized representation of rolled clothing stored in a clear drawer.

Referring to FIG. 6, there is shown a rolled shirt 200 with the wrinkle reducing rolling device 100 internally positioned by rolling, which can be optionally secured with pin, etc. and uniformly stacked into a drawer 210, shown in FIG. 7. Layers of shirts 200 rolled with the wrinkle reducing rolling device 100 can be separated with a lifting sheet/tray (not shown). Alternatively the shirts rolled with the wrinkle reducing rolling device 100 can be stacked in an open sided box where they are highly visible and easily removed.

The wrinkle reducing rolling device 100 can be made of various types of plastics, paper, treated paper, laminated paper, corrugated paper/cardboard as well as many other materials that are equally well suited for use.

In order to better prevent folded creases in the shirt 200, embodiments of the wrinkle reducing rolling device 100 may be provided with a curved shape as shown in FIG. 1*b*, or be manufactured to have a natural tendency to curve when rolled (be easily curvable). A natural tendency to curve can be provided by providing grooves on the concaved surface 124. Referring to FIG. 1*c* there is shown a detailed close-up of a cross section of the wrinkle-reducing device 100 which is initially flat with grooves 126 on the concave surface 124. Referring to FIG. 1*d* there is shown a detailed close-up of a cross section of another embodiment of the wrinkle-reducing device 100 which is initially flat with grooves 126 on the concave surface 124 which also form ridges 128 on the convex surface 114. While the grooves and ridges are shown as triangular, any of a variety of geometries can be utilized, including a "U" shape, sideways "C" shape, etc.

Figure 8A:
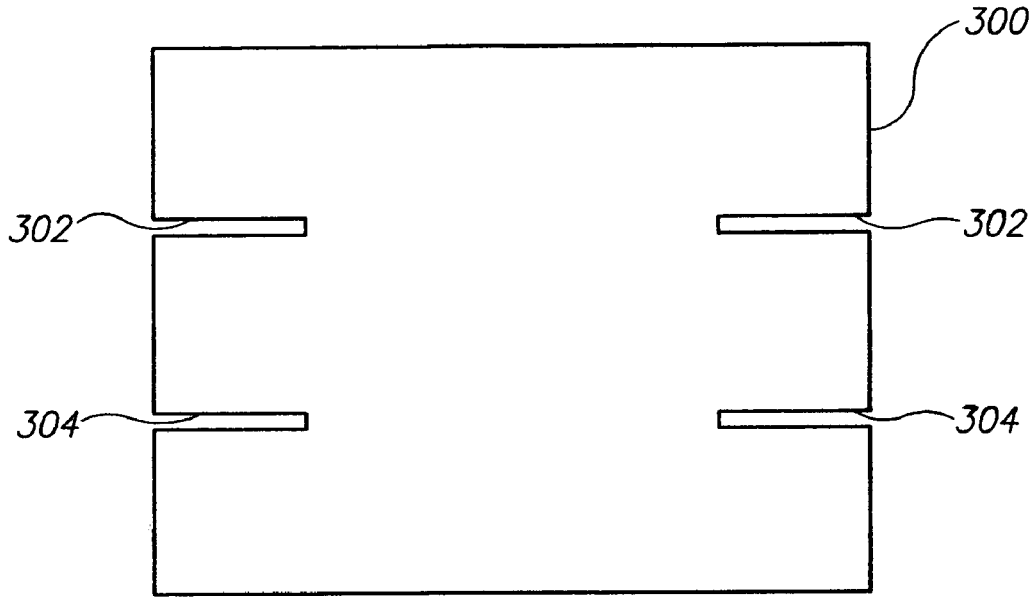
FIGS. 8*a*, 8*b* and 8*c* are alternate embodiments of the wrinkle reducing rolling device; and, FIG. 9 is yet another alternate embodiment of the wrinkle reducing rolling device.

Referring to FIG. 8*a* there is shown an alternate embodiment of the wrinkle reducing rolling device. The wrinkle reducing rolling device has two pairs of slots or slits 302 and 304 which enable capture of the shirt in the area of the armpit. In order to prevent folded creases in the shirt (not shown), the wrinkle reducing rolling device 300 may have a curved shape such as shown in FIG. 1*b*, or be manufactured to have a natural tendency to curve (be easily curvable). A natural tendency to curve can be provided by providing grooves on the concaved surface 124. Referring to FIG. 1*c* there is shown a detailed close-up of a cross section of the wrinkle-reducing device 100 which is initially flat with grooves 126 on the concave surface 124. Referring to FIG. 1*d* there is shown a detailed close-up of a cross section of another embodiment of the wrinkle-reducing device 100 which is initially flat with grooves 126 on the concave surface 124 which also form ridges 128 on the convex surface 114. While the grooves and ridges are shown as triangular, any of a variety of geometries can be utilized, including a "U" shape, sideways "C" shape, etc.

Figure 8B:
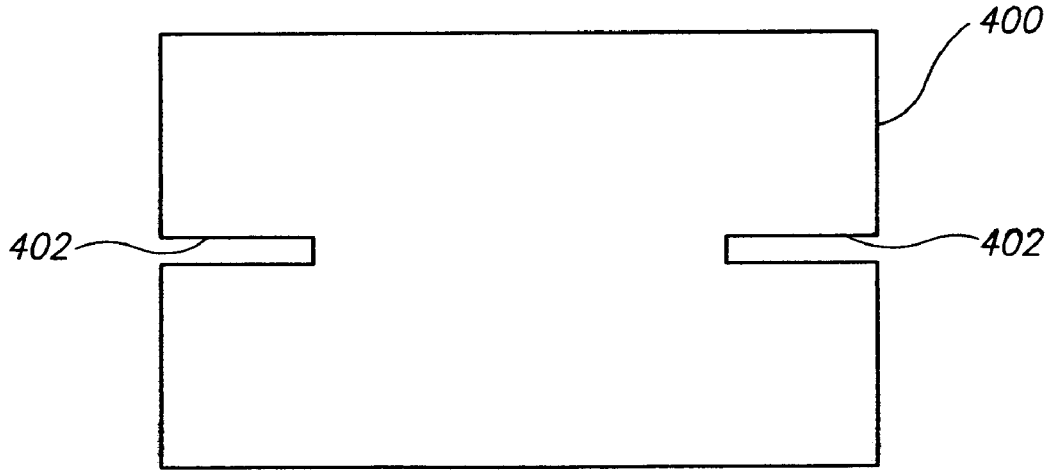

Referring to FIG. 8*b* there is shown an alternate embodiment of the wrinkle reducing rolling device. The wrinkle reducing rolling device has a pairs of slots or slits 402 which enable capture of the shirt in the area of the armpit. In order to prevent folded creases in the shirt (not shown), the wrinkle reducing rolling device 400 must have a curved shape such as shown in FIG. 1*b*, or be manufactured to have a natural tendency to curve (be easily curvable). A natural tendency to curve can be provided by providing grooves on the concaved surface 124. Referring to FIG. 1*c* there is shown a detailed close-up of a cross section of the wrinkle-reducing device 100 which is initially flat with grooves 126 on the concave surface 124. Referring to FIG. 1*d* there is shown a detailed close-up of a cross section of another embodiment of the wrinkle-reducing device 100 which is initially flat with grooves 126 on the concave surface 124 which also form ridges 128 on the convex surface 114. While the grooves and ridges are shown as triangular, any of a variety of geometries can be utilized, including a "U" shape, sideways "C" shape, etc.

Figure 8C:
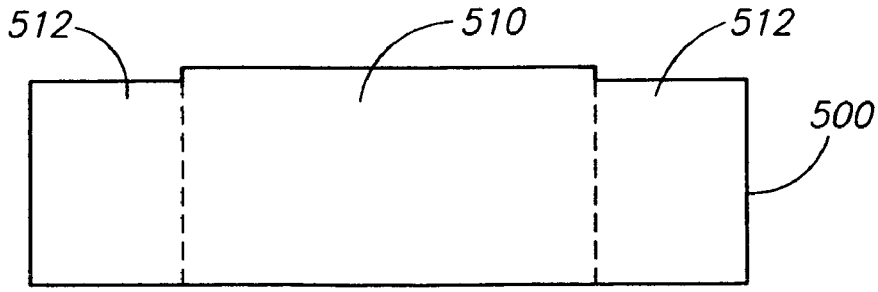

Referring to FIG. 8*c* there is shown a further embodiment of the wrinkle reducing rolling device 500. By taking the embodiment shown in FIG. 4*b* and folding along a line which passes through slots or slits 402, a two-layer device is made. The folded center portion 510 of the wrinkle reducing rolling device 500 can optionally have the two layers bonded together, thus providing bendable end flaps 512 for capturing the shirt (not shown). A small tube, like a straw inside the folded edge (between the two layers) optionally provides a rounded corner to further reduce creasing.

Figure 9:
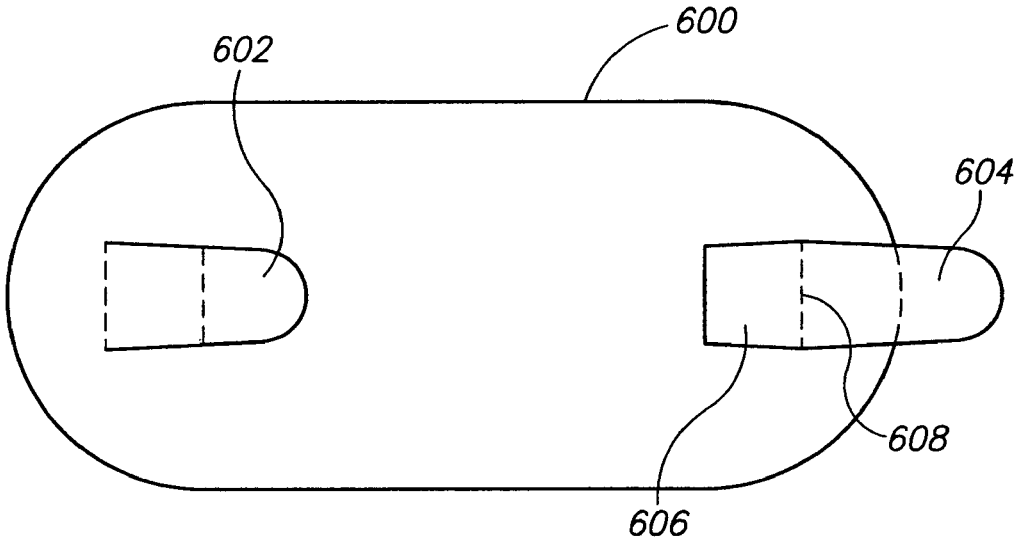

FIG. 9 is yet another alternate embodiment of the wrinkle reducing rolling device. "U" shaped cutouts 602 and 604 capture the clothing item being rolled. In this case, the clothing can be pants which are folded so that the legs are on top of each other. The "U" shaped cutouts 602 and 604 capture the pant legs. A bendable line 608 enables the pant legs to be slipped under and captured. The "U" shaped cutouts 602 and 604 can be cut from an upper layer of two or more layers of material.

Numerous modifications and alternative embodiments of the invention will be apparent to those skilled in the art in view of the foregoing description. Such as using composite or layered materials to provide a tendency to curve when rolled. Additionally, in yet a further embodiment, the wrinkle reducing rolling device may be made so as to be curvable in either direction, such as grooving both surfaces, or layering a less compressible material with easier to compress materials (such as soft foam or even corrugated cardboard with one face open. The top and or bottom edges of the wrinkle reducing rolling device can have a small lip, a tube or foam edge or other addition which will reduce the sharp edge which might crease the item being rolled. Accordingly, this description is to be construed as illustrative only and is for the purpose of teaching those skilled in the art the best mode of carrying out the invention. Details of the structure may be varied substantially without departing from the spirit of the invention and the exclusive use of all modifications, which come within the scope of the appended claims, is reserved. While the wrinkle reducing rolling device is particularly well suited for use with a shirt, sweater, t-shirt, etc. and is so described herein, it is equally well suited for other cloth articles of clothing such as ties, sheets, pillowcases etc.

I claim:

1. A method for rolling and storing an article of clothing comprising:

providing a flexible oblong element having a first slot and a second slot positioned near opposite ends of the flexible oblong element, the flexible element having an essentially curved shape when rolled from a top edge to a bottom edge;

capturing the article of clothing with the first slot and the second slot;

rolling the captured article of clothing when rolling the article of clothing and the flexible oblong element forms an internal structure within the rolled article of clothing whereby rolling the article of clothing reduces the formation of wrinkles and creases as well as reduces existing wrinkles.

2. A device for rolling and storing an article of clothing comprising:

a flexible oblong element having a first slot and a second slot positioned near opposite ends of the flexible oblong element, the flexible element having an essentially curved shape when rolled from a top edge to a bottom edge;

wherein the first slot and the second slot capture the article of clothing when rolling the article of clothing and the flexible oblong element forms an internal structure within the rolled article of clothing whereby rolling the article of clothing reduces the formation of wrinkles and creases as well as reduces existing wrinkles; and wherein the flexible oblong element is precurved.

3. A device for rolling and storing an article of clothing comprising:

a flexible oblong element having at least a first c-shaped slot and a second c-shaped slot positioned near opposite ends of the flexible oblong element and having the open portions of the c-shapes facing inwards, the flexible element having an essentially curved shape when rolled from a top edge to a bottom edge;

wherein the element material within and surrounding the first c-shaped slot and the second c-shaped slot forms a first and second snap action clips to capture the article of clothing when rolling the article of clothing and the flexible oblong element forms an internal structure within the rolled article of clothing whereby rolling the article of clothing reduces the formation of wrinkles and creases as well as reduces existing wrinkles.

4. A device for rolling and storing an article of clothing comprising:

a flexible oblong element having a first slot and a second slot positioned near opposite ends of the flexible oblong element, the flexible element having an essentially curved shape when rolled from a top edge to a bottom edge;

wherein the first slot and the second slot capture the article of clothing when rolling the article of clothing and the flexible oblong element forms an internal structure within the rolled article of clothing whereby rolling the article of clothing reduces the formation of wrinkles and creases as well as reduces existing wrinkles; and wherein at least one surface of the flexible oblong is grooved.

5. A device for rolling and storing an article of clothing comprising:

a flexible oblong element wherein the flexible oblong element is primarily rectangular in shape and folded with the folded edge primarily parallel to the axis of rolling and having a first slot forming an outwardly opening snap action clip and a second slot forming an outwardly opening snap action clip, the slots positioned near opposite ends of the flexible oblong element, the flexible element having an essentially curved shape when rolled from a top edge to a bottom edge;

wherein the snap action clips formed by the first slot and the second slot capture the article of clothing when rolling the article of clothing and the flexible oblong element forms an internal structure within the rolled article of clothing whereby rolling the article of clothing reduces the formation of wrinkles and creases as well as reduces existing wrinkles.

6. A device for rolling and storing an article of clothing comprising:

a flexible oblong element having a first slot forming an outwardly opening snap action clip and a second slot forming an outwardly opening snap action clip positioned near opposite ends of the flexible oblong element, the flexible element having an essentially curved shape when rolled from a top edge to a bottom edge, and further comprising holes for inserting a stick;

wherein the snap action clips formed by the first slot and the second slot capture the article of clothing when rolling the article of clothing and the flexible oblong element forms an internal structure within the rolled article of clothing whereby rolling the article of clothing reduces the formation of wrinkles and creases as well as reduces existing wrinkles.

7. The device as recited in claim 6 wherein the stick is treated with cedar essence.

8. The device as recited in claim 6 wherein the stick adsorbs a fragrance.

9. A system for rolling and storing an article of clothing comprising:

a pre-curved, flexible oblong element having a first slot and a second slot positioned near opposite ends of the flexible oblong element, the flexible element having an essentially curved shape when rolled from a top edge to a bottom edge wherein the first slot and the second slot capture the article of clothing;

wherein rolling the article of clothing with the flexible oblong element, the flexible oblong element forms an internal structure within the rolled article of clothing whereby rolling the article of clothing reduces the formation of wrinkles and creases as well as reduces existing wrinkles.

10. A system for rolling and storing an article of clothing comprising:

a flexible oblong element having at least one textured surface and having at least a first and second outwardly opening snap action clip positioned near opposite ends of the flexible oblong element, the flexible element having an essentially curved shape when rolled from a top edge to a bottom edge wherein the first outwardly opening snap action clip and the second outwardly opening snap action clip slot capture the article of clothing;

wherein rolling the article of clothing with the flexible oblong element, the flexible oblong element forms an internal structure within the rolled article of clothing whereby rolling the article of clothing reduces the formation of wrinkles and creases as well as reduces existing wrinkles.

11. A system for rolling and storing an article of clothing comprising:

a flexible oblong element having at least one grooved surface and having a first slot and a second slot positioned near opposite ends of the flexible oblong element, the flexible element having an essentially curved shape when rolled from a top edge to a bottom edge wherein the first slot and the second slot capture the article of clothing;

wherein rolling the article of clothing with the flexible oblong element, the flexible oblong element forms an internal structure within the rolled article of clothing whereby rolling the article of clothing reduces the formation of wrinkles and creases as well as reduces existing wrinkles.

12. A system for rolling and storing an article of clothing comprising:

a flexible oblong element having a first outwardly opening snap action clip and a second outwardly opening snap action clip positioned near opposite ends of the flexible oblong element and further comprising holes in the flexible oblong element for inserting a stick, the flexible element having an essentially curved shape when rolled from a top edge to a bottom edge;

wherein the first outwardly opening snap action clip and the second outwardly opening snap action clip capture the article of clothing; and wherein rolling the article of clothing with the flexible oblong element, the flexible oblong element forms an internal structure within the rolled article of clothing whereby rolling the article of clothing reduces the formation of wrinkles and creases as well as reduces existing wrinkles.

13. The system as recited in claim 12 wherein the stick is treated with cedar essence.

14. The system as recited in claim 12 wherein the stick adsorbs a fragrance.

15. A system for rolling and storing an article of clothing comprising:

a flexible oblong element containing a plurality of small perforations and having a first outwardly opening snap action clip and a second outwardly opening snap action clip positioned near opposite ends of the flexible oblong element, the flexible element having an essentially curved shape when rolled from a top edge to a bottom edge;

wherein the first outwardly opening snap action clip and the second outwardly opening snap action clip capture the article of clothing;

wherein rolling the article of clothing with the flexible oblong element, the flexible oblong element forms an internal structure within the rolled article of clothing whereby rolling the article of clothing reduces the formation of wrinkles and creases as well as reduces existing wrinkles.

16. A system for rolling and storing an article of clothing comprising:

a flexible oblong element having at least one textured region to enhance capture of the article of clothing and having a first outwardly opening snap action clip and a second outwardly opening snap action clip positioned near opposite ends of the flexible oblong element, the flexible element having an essentially curved shape when rolled from a top edge to a bottom edge;

wherein the first outwardly opening snap action clip and the second outwardly opening snap action clip capture the article of clothing;

wherein rolling the article of clothing with the flexible oblong element, the flexible oblong element forms an internal structure within the rolled article of clothing whereby rolling the article of clothing reduces the formation of wrinkles and creases as well as reduces existing wrinkles.

* * * * *